US006517196B1

(12) United States Patent
Bruil et al.

(10) Patent No.: US 6,517,196 B1
(45) Date of Patent: Feb. 11, 2003

(54) INKJET PRINTHEAD

(75) Inventors: Anton Bruil, Venlo (NL); Marc Paul Schuwer, Eindhoven (NL); Franciscus J. H. M. van den Beucken, Beringe (NL); Ralf-Peter Peters, Bergisch-Gladbach (DE); Ying Yu, Dortmund (DE); Holger Reinecke, Dortmund (DE)

(73) Assignee: Océ-Technologies B.V., Venlo (NL)

( * ) Notice: Subject to any disclaimer, the term of this patent is extended or adjusted under 35 U.S.C. 154(b) by 0 days.

(21) Appl. No.: 09/551,729

(22) Filed: Apr. 18, 2000

(30) Foreign Application Priority Data

Apr. 19, 1999 (EP) ..... 99201243

(51) Int. Cl.[7] ..... B41J 2/045
(52) U.S. Cl. ..... 347/70
(58) Field of Search ..... 347/68, 69, 70, 347/71, 72

(56) References Cited

U.S. PATENT DOCUMENTS 4,657,631 A 4/1987 Noguchi ..... 216/27
5,710,584 A * 1/1998 Suzuki et al. ..... 347/70
5,729,263 A * 3/1998 Thiel et al. ..... 347/71
5,767,612 A * 6/1998 Takeuchi et al. ..... 310/324
5,818,481 A * 10/1998 Hotomi et al. ..... 347/68
5,876,582 A 3/1999 Frazier ..... 205/122
5,997,134 A * 12/1999 Hotomi et al. ..... 347/70
6,074,047 A * 6/2000 Hotomi et al. ..... 347/70
6,126,279 A * 10/2000 Shimada et al. ..... 347/70

FOREIGN PATENT DOCUMENTS

| | | |
|---|---|---|
| EP | A1 819524 | 1/1998 |
| EP | A2 827833 | 3/1998 |
| JP | 62 135377 | 6/1987 |

* cited by examiner

*Primary Examiner*—John Barlow
*Assistant Examiner*—Blaise Mouttet
(74) *Attorney, Agent, or Firm*—Birch, Stewart, Kolasch & Birch, LLP

(57) ABSTRACT

An inkjet printhead containing at least one ink channel communicating with a nozzle and defined between two opposed side walls; a membrane interconnecting the side walls; and actuating elements arranged adjacent to the membrane for deflecting the same, wherein the side walls and the membrane are formed by a one-piece member.

5 Claims, 2 Drawing Sheets

INKJET PRINTHEAD

BACKGROUND OF THE INVENTION

The present invention relates to an inkjet printhead comprising at least one ink channel connected to a nozzle and defined between two opposing side walls; a membrane interconnecting the side walls; and actuating means arranged adjacent to the membrane for deflecting the membrane.

A conventional printhead of the type, which is disclosed for example in EP-A-0 819 524, comprises a plurality of ink channels which are arranged side-by-side so that the associated nozzles form a linear nozzle array. The ink channels and the nozzles are formed by grooves cut into the surface of a substrate which may, for example, be made of silicon. The membranes for the various ink channels are formed by a continuous thin sheet which is overlaid on the substrate so that it covers the open top sides of the grooves. This sheet has to be firmly bonded to the regions of the substrate defining the side walls of the ink channels. The actuators are formed by piezo-electric fingers which are supported by a common backing plate and have their respective free ends bonded to the top surfaces of the membranes, so that, when a voltage is applied to one of the piezo-electric fingers, the corresponding membrane is flexed into the volume of the associated ink channel which is filled liquid ink, so that an ink droplet is expelled from the nozzle.

U.S. Pat. No. 4,657,631 discloses another type of printhead in which the ink channels are formed by groove-like structures in a metal layer which is formed on the flat surface of the substrate. Thus, the bottom wall of each ink channel is formed by a portion of the substrate, and rigid side walls and a rigid top wall are formed by the metal layer. The actuators are disposed inside of each ink channel and are disposed on the surface of the substrate, so that they are directly exposed to the ink liquid without a membrane intervening between the actuator and the ink. This type of printhead can be manufactured by forming a photo-sensitive layer on the surface of the substrate and by exposing and developing this layer, thereby forming a pattern of ridges which have a shape complementary to that of the ink channels. A metal layer is then formed on the surface of the substrate by sputtering and subsequent electronic plating, until the ridges are buried in the metal layer, the photo-sensitive material is then removed so that the ink channels are formed in the metal layer.

SUMMARY OF THE INVENTION

It is an object of the present invention to provide an inkjet printhead which can be manufactured more easily and with a higher production yield. According to the present invention, the side walls and the membrane are formed by a one-piece member. This construction has the advantage that, on the one hand, the membrane can be made very thin so that it has a higher flexibility, and, on the other hand, the member forming the membrane and the side walls of the ink channels can, as a whole, have a comparatively high structural strength. This greatly facilitates the manufacturing process and makes it possible to achieve a high production yield.

Advantageously, the one-piece member which forms the membranes and the side walls of the plurality of ink channels is a metal foil which is obtained in a growth process such as electroforming. This has the advantage that the membrane can be made very thin and the thickness thereof can be controlled with high accuracy. Further, since the foil can be formed directly on the surface on the substrate, no assembly process or separate bonding step is required for forming a complete channel plate, including the substrate, and the metal foil which forms the membrane and the side walls of the ink channels.

By forming the metal foil on the surface of a photoresist which has appropriately been shaped by means of photolithographic techniques, it is possible to obtain a three-dimensional structure of the foil which forms not only the membrane and the side walls of the ink channels but also the nozzles, with appropriate sizes and shapes. The cross-section of the foil in a plane normal to the axis of the ink channels has a meandering-like shape, with a space formed between the portions of the foil which define the side walls of two adjacent ink channels. This construction greatly reduces the amount of mechanical or acoustic coupling between the adjacent ink channels, so that cross-talk among the various channels of the printhead is reduced significantly. In addition, this cross-sectional shape of the foil has the effect that the thermal expansion of the channel plate is controlled only by the material of the substrate, e.g. silicon, which is particularly useful when the printhead is used for hot-melt ink and, accordingly, operates at high temperatures. Since the nozzles are formed directly by the three-dimensionally structured foil, no mechanical finishing of the nozzle front of the printhead is necessary.

By providing a thin metal layer on the surface of the substrate on which the foil is applied in a later manufacturing step, it is possible to obtain a design in which the ink channels and, more important, also the nozzles are completely surrounded by only one type of material, i.e. metal, so that the directionality of the droplet-formation process will not be influenced by differences in the adhesiveness of the walls defining the nozzles.

BRIEF DESCRIPTION OF THE DRAWINGS

Preferred embodiments of the invention will now be described in conjunction with the accompanying drawings, in which.

DETAILED DESCRIPTION OF THE INVENTION

Figure 1:
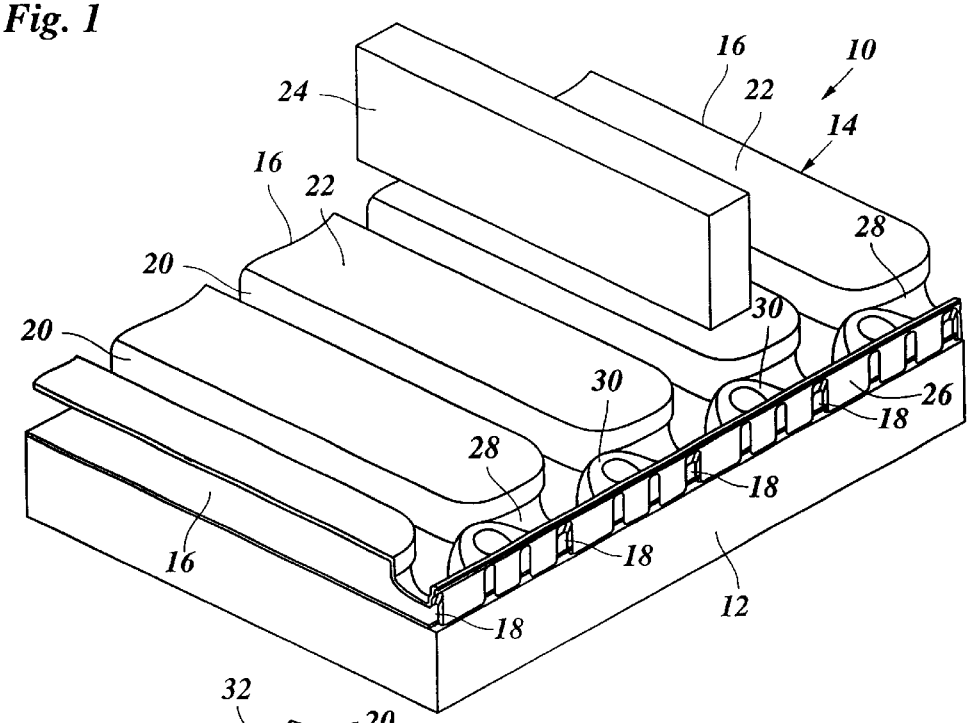
FIG. 1 is a perspective view of THE essential parts of an inkjet printhead according to the present invention.

As is shown in FIG. 1, the inkjet printhead comprises a channel plate 10 which has a substrate 12 made of silicon, and a three-dimensionally structured metal foil 14 formed on the flat top surface of the substrate 12. The foil 14 defines a plurality of parallel ink channels 16 which are arranged side-by-side and each converge to a nozzle 18, so that the nozzles form a linear array along the front side of the substrate 12.

Each ink channel 16 has a pair of opposed side walls 20 which are interconnected by a membrane 22, so that the membrane 22 forms a top wall of the ink channel opposite to the substrate 12. The side walls 20 and membranes 22 of all the ink channels 16 are integrally formed by a one-piece member, i.e. by the metal foil 14.

The printed further comprises a plurality of piezo-electric actuators 24 only one of which is shown in FIG. 1. The actuators 24 are disposed on each of the membranes 22, so that, when they are electrically energized, they perform expansion stroke, and the membrane 22 flexes into the interior of the ink channel. Thus, when the ink channel is filled with liquid ink, an ink droplet will be expelled from the nozzle 18.

The foil 14 also forms a front wall 26 in which the nozzles 18 are defined. Each nozzle is connected to the associated ink channel 16 by a funnel portion 28 which is also an integrated part of the foil 14. Further, the foil 14 forms crater-like reinforcement members 30 which are partially cut by the front wall 26 and are provided between the nozzles 18 for improving the structural strength of the front wall 26.

Figure 2:
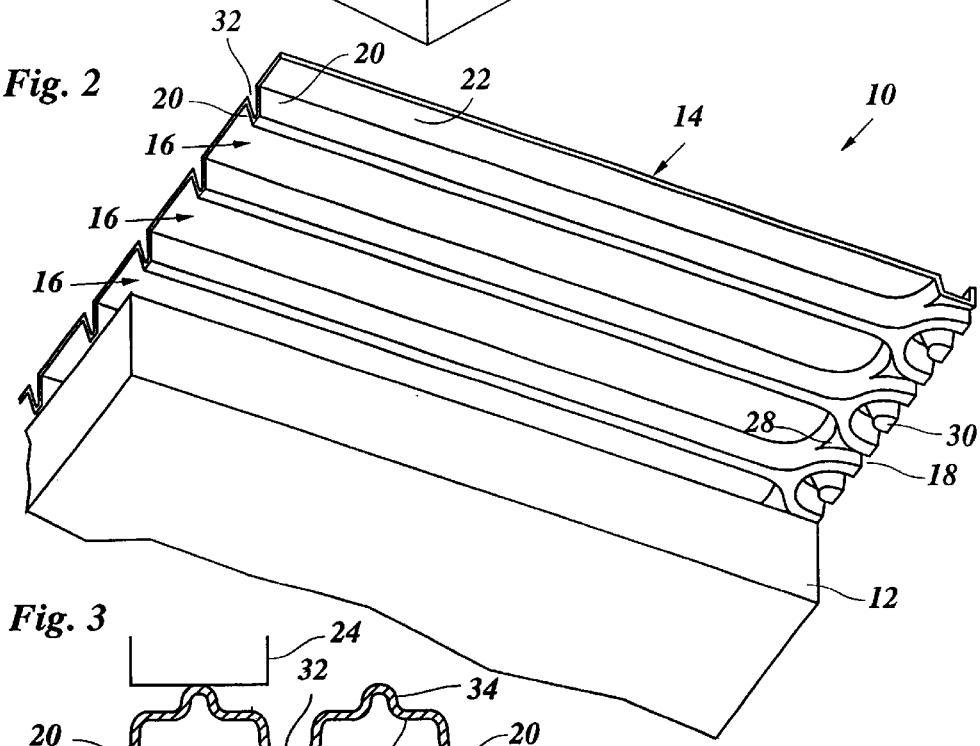
FIG. 2 is a perspective bottom view of the printhead with parts of a substrate being removed for illustration purposes.
Figure 3:
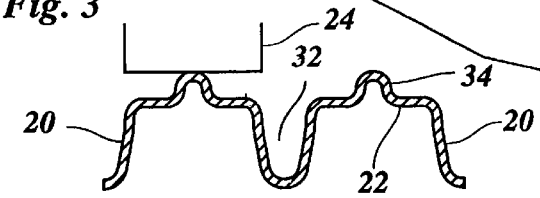
FIG. 3 is a cross-sectional view of a member defining the ink channels of the printhead according to a modified example.

As can be seen more clearly in FIGS. 2 and 3, the foil 14 has a meander-like cross-sectional shape in a plane normal to the longitudinal direction of the ink channels 16, with V-shaped concave spaces 32 formed between the side walls 20 of each pair of adjacent ink channels. Thus, when an individual actuator 24 is energized and an acoustic pressure wave is generated in the ink liquid contained in the associated ink channel 16, the space 32 will prevent this pressure wave from being transmitted to the neighboring ink channels, so that cross-talk among the various channels is avoided. In addition, due to its meander-like cross-section, the foil 14 can behave like an expansion bellow and can adapt itself to thermal expansions of the substrate 12 without causing a distortion of the channel plate 10 as a whole. On the other hand, when exposed to vertical pressure, the foil 14 has a comparatively high strength and is surprisingly robust, even when the thickness of the foil is only in the order of several $\mu$m.

In a typical embodiment, the thickness of the foil in the portion forming the membranes 22 is between 3 and 30 $\mu$m, preferably 15 $\mu$m, with an accuracy of $\pm 1$ $\mu$m. This assures a high flexibility of the membranes 22 so that the mechanical energy of the actuators 24 is readily transmitted to the ink liquid. The high level of accuracy in the membrane thickness assures a uniform performance of all of the ink channels.

FIG. 3 illustrates a modified embodiment in which an outwardly projecting ridge or bump 34 is formed along the longitudinal center line of each membrane 22 which allows for a high amount of deflexion of the membrane with little strain on the foil material, even when the width of the actuator 24 is comparatively large.

A process of manufacturing the channel plate 10 will now be described in conjunction with FIGS. 4–9.

Figure 4:
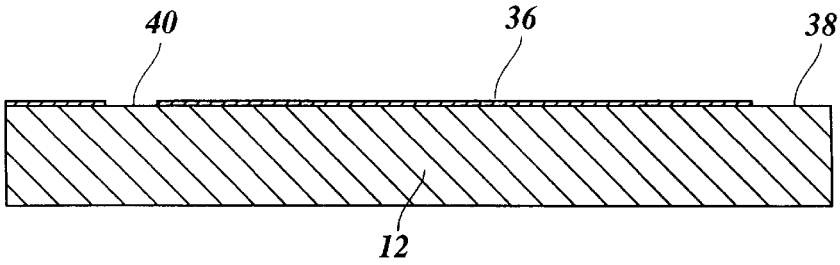
FIGS. 4–9 illustrate a sequence of steps for manufacturing the printhead according to the present invention.
Figure 5:
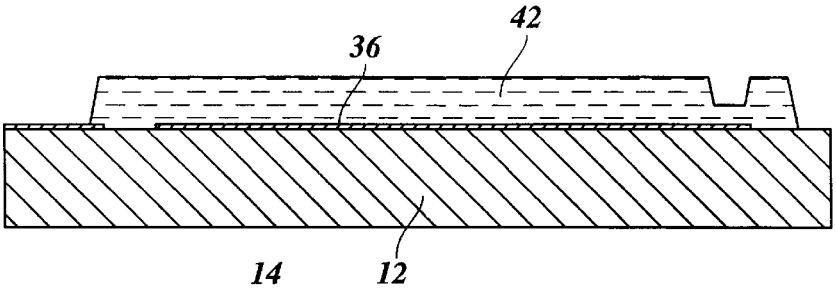

At first, as is shown in FIG. 4, a thin layer 36 of metal, e.g. of nickel or a nickel alloy is formed on the flat top surface of the substrate 12. The layer 36 covers the whole surface of the substrate with the exception of a portion 38 directly adjacent to the nozzle side of substrate and a hole 40 near the rear end of each ink channel. Then, a three-dimensionally structured photoresist 42 is applied on the substrate and on the layer 36 by means of photolithographic techniques. The shape of the photoresist 42 is complementary to the relief of the bottom side of the foil 14 shown in FIG. 2.

Figure 6:
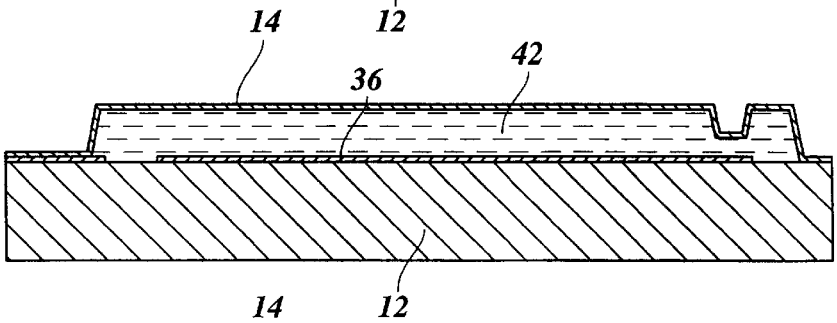
Figure 7:
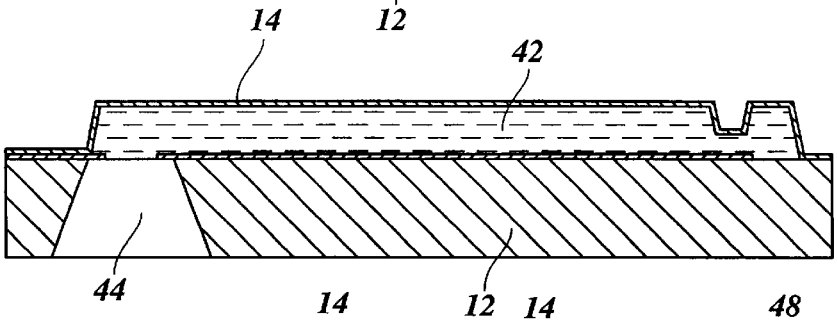

In the next step, the foil 14 is formed on the surface of the layer 36 and on the surface of the photoresist 42 by means of a nickel-electroforming process. The result is shown in FIG. 6. Then, as is shown in FIG. 7, an ink feed channel 44 is formed in the substrate 12 by etching, laser drilling, powder blasting or the like.

Figure 8:
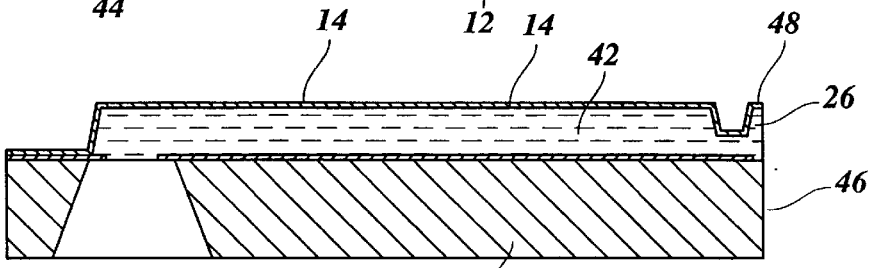

In order to form the nozzle face 46 of the channel plate FIG. 8, a dicing cut is performed in the substrate 12, the photoresist 42, and the foil 14. The plane of this dicing cut is slightly offset from the front wall 26 of the foil 14, so that a small horizontal flange 48 is formed along the upper edge of the front wall 26.

Figure 9:
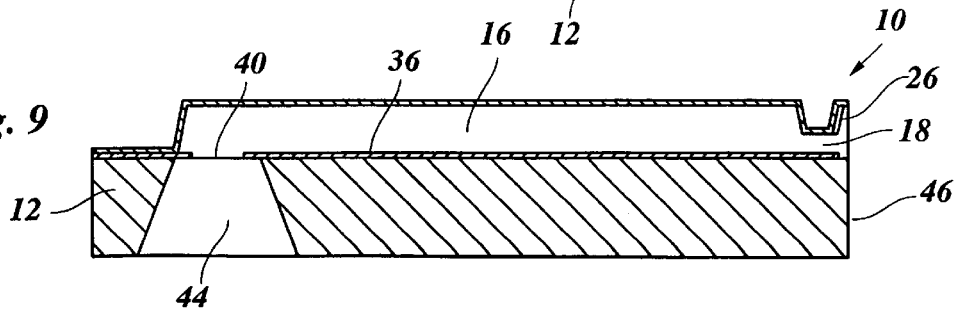

Finally, the photoresist 42 is removed, so that the ink channel 16 and the nozzle 18 are formed, as is shown in FIG. 9. The ink channel communicates with the ink feed channel 44 through the hole 40 formed in the layer 36. As is also shown in FIG. 9, the front edge of the layer 36 is located in the same longitudinal position as the upper and outer edge of the wall of the nozzle 18, so that the mouth of the nozzle 18 lies in a plane normal to plane of the substrate 12 and is slightly recessed from the main part of the front wall 26. As a result, the droplets will be expelled in a direction strictly aligned with the longitudinal direction of the ink channel, and no finishing needs to be applied to the nozzle face.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An inkjet printhead comprising:

at least one ink channel communicating with a nozzle and defined between two opposed side walls;

a membrane interconnecting the side walls; and actuating means arranged adjacent to the membrane for deflecting the same, wherein the side walls and the membrane are formed by a one-piece member made of a metal, said one-piece member being obtained by a growth process, and wherein a side of the ink channel disposed opposite to the membrane is closed by a substrate on which the one-piece metal member is grown.

2. An inkjet printhead comprising:

at least one ink channel communicating with a nozzle and defined between two opposed side walls;

a membrane interconnecting the side walls; and actuating means arranged adjacent to the membrane for deflecting the same, wherein the side walls and the membrane are formed by a one-piece member made of a metal, and wherein the nozzle and a funnel portion connecting the ink channel to the nozzle are also defined by said one-piece member.

3. The inkjet printhead according to claim 2, wherein a portion of the substrate delimiting the ink channel, the funnel portion and the nozzle are covered by a layer made of the same material as the one-piece member.

4. An inkjet printhead comprising:

a plurality of ink channels communicating with associated nozzles, said ink channels being arranged side-by-side so that the associated nozzles form a linear array, said ink channels being defined by opposing side walls, a front wall and a membrane interconnecting the opposing side walls, said side walls, front wall and membrane being formed by a one-piece member made of a continuous metal foil, said linear array of nozzles being defined in the metal foil forming the front wall, the apertures of the individual nozzles being recessed relative to the front wall, said ink channels having a meanderingly shaped cross-section in a plane normal to the ink channels, and actuating means arranged adjacent to the membrane for deflecting the same.

5. An inkjet printhead comprising:

at least one ink channel communicating with a nozzle and defined between two opposed side walls, a membrane interconnecting the side walls, and actuating means arranged adjacent to the membrane for deflecting the same, said actuating means being adapted to engaged an outwardly projecting ridge formed in a central portion of the membrane, wherein the side walls and the membranes are formed by a one-piece member made of a metal.

* * * * *